US009657965B2

(12) United States Patent
Nolte et al.

(10) Patent No.: US 9,657,965 B2
(45) Date of Patent: May 23, 2017

(54) WATER HEATER AND METHOD OF CONTROLLING A WATER HEATER

(71) Applicant: Stiebel Eltron GmbH & Co. KG, Holzminden (DE)

(72) Inventors: Hubert Nolte, Höxter (DE); Frank Stiebel, West Hatfield, MA (US)

(73) Assignee: Stiebel Eltron GmbH & Co. KG, Holzminden (DE)

( * ) Notice: Subject to any disclaimer, the term of this patent is extended or adjusted under 35 U.S.C. 154(b) by 0 days.

(21) Appl. No.: 14/640,834

(22) Filed: Mar. 6, 2015

(65) Prior Publication Data

US 2016/0258652 A1 Sep. 8, 2016

(51) Int. Cl.

| | |
|---|---|
| ***F24H 1/20*** | (2006.01) |
| ***H05B 3/78*** | (2006.01) |
| ***F24H 9/00*** | (2006.01) |
| ***H05B 3/82*** | (2006.01) |
| ***F24H 9/20*** | (2006.01) |
| ***C23F 13/00*** | (2006.01) |
| ***C23F 13/04*** | (2006.01) |

(52) U.S. Cl.

CPC ..... *F24H 9/0047* (2013.01); *C23F 13/005* (2013.01); *C23F 13/04* (2013.01); *F24H 1/203* (2013.01); *F24H 9/2021* (2013.01); *H05B 3/82* (2013.01)

(58) Field of Classification Search

None

See application file for complete search history.

(56) References Cited

U.S. PATENT DOCUMENTS

| | | | | |
|---|---|---|---|---|
| 4,975,560 | A * | 12/1990 | Wardy | G23F 13/02 204/196.05 |
| 5,023,928 | A * | 6/1991 | Houle | C23F 13/005 204/196.04 |
| 7,372,005 | B2 * | 5/2008 | Knoeppel | C23F 13/04 204/196.06 |
| 8,068,727 | B2 * | 11/2011 | Phillips | F24H 9/0047 392/441 |
| 2001/0040568 | A1 * | 11/2001 | Park | G09G 5/006 345/211 |
| 2006/0274026 | A1 * | 12/2006 | Kerofsky | G09G 3/22 345/102 |
| 2010/0053222 | A1 * | 3/2010 | Kerofsky | G09G 3/3406 345/690 |

(Continued)

*Primary Examiner* — Thor Campbell
(74) *Attorney, Agent, or Firm* — Haug Partners LLP

(57) ABSTRACT

A water heater is provided which comprises a water storage tank made of enameled metal, an anode electrode (e.g. an anode rod) at least partly inside the water storage tank and a corrosion protection unit configured to impress current into the anode to provide a corrosion protection for the water storage tank. The corrosion protection unit further comprises a microprocessor configured to control the impressing of the current to the anode electrode during impression process cycles and to control the operation of the corrosion protection. The corrosion protection unit furthermore comprises a battery unit or an accumulator unit configured to supply energy to the microprocessor during grid power outages. The microprocessor is configured to activate the power saving mode during grid power outages during which an amount of impressed current and/or an impression process cycle is reduced.

4 Claims, 2 Drawing Sheets

(56) References Cited

U.S. PATENT DOCUMENTS

| | | | | |
|---|---|---|---|---|
| 2014/0218005 | A1* | 8/2014 | Farris | G01N 17/02 324/71.2 |
| 2014/0267360 | A1* | 9/2014 | Finkel | G06T 11/001 345/590 |
| 2014/0376899 | A1* | 12/2014 | Boros | C23F 13/00 392/457 |
| 2015/0290406 | A1* | 10/2015 | Bertinetti | A61M 16/0051 128/202.22 |
| 2016/0097563 | A1* | 4/2016 | Farris | F24H 9/2035 122/14.22 |

* cited by examiner

WATER HEATER AND METHOD OF CONTROLLING A WATER HEATER

FIELD OF THE INVENTION

The present invention relates to a water heater and a method of controlling a water heater.

It is noted that citation or identification of any document in this application is not an admission that such document is available as prior art to the present invention.

Water heaters often comprise a storage tank which is made of enameled steel or stainless steel. Such enameled steel tanks are however prone to corrosion. The corrosion risk is due to possible texture defects in the glass lined surface of the storage tank wall. In order to provide a corrosion protection, typically a magnesia sacrificial anode (e.g. a passive corrosion protection system) can be provided. The magnesia material of the anode and the lime content of the water are transported to the corrosion spot and is covering the steel with a magnesia and magnesia lime layer. Hence, the water inside the tank, the steel corrosion spot, and the anode act as an electrochemical cell. The anode rod should be conductively coupled to the steel tank. The corrosion spot can act as a cathode and the sacrificial anode can serve as a donator and the corrosion spot can act as a receiver.

Passive corrosion protection systems with sacrificial anodes need an increased maintenance demand which creates expense. In addition, self corrosion effects due to different water conductivities and salt concentration of the water may increase the maintenance demand in addition.

Furthermore, the corrosion protection can also be provided by an active system namely by a current impressed system. Current impressed systems reduce on one hand the maintenance expense but on the other hand a permanent connection to a power supply is required to deliver corrosion protection. A cathodic corrosion protection with an impressed current anode is well known in the art. Here, a DC current is frequently impressed into the water inside the storage tank. The water acts as an electrolyte the metallic rod acts as an electrode during the pauses after impressing the current into the water, a measurement process is performed to determine the current level for the next current impressing phase. Such a current impressing phase may be interrupted each 10 ms. The measurement period has a duration of typically 400 μs. The electrical potential between the electrode rod and the inner surface of the tank is determined during those measurement periods. The required electric potential is typically 2.1V. Hence, the set point level is set at 2.1V.

The current level which needs to be impressed into the water is controlled as a function of the conductivity of the water as well as a number of surface defects in the glass lined texture. By choosing an appropriate material for the electrode an electrode self corrosion effect can be avoided. Preferred material for the electrode is titan material which needs to be coated with a platin iridiumoxyd surface to avoid a polarization of the electrode during the measurement intervals. The polarization of the electrode may cause inaccurate measurement after each current impressed interval. The orientation of the current impressed into the water in the direction of the corrosion spot has the opposite orientation than the corrosion current which reduces the steel material of the corrosion spot. The effect of the polarization retards the corrosion effect. As a safety mechanism the heating system of the water heater is deactivated if the measured potential is between 0.2V and 1.2V as this indicates that no water is inside the tank. Such a protection scheme is also described as a dry fire prevention function.

As mentioned above, a current impressed corrosion prevention system delivers an effective corrosion protection as long the system is fed with electric energy. It needs to be connected to an active network grid and is supplied with energy.

In order to provide a current impressed corrosion protection system even during power outage, the system may be provided with a battery or back up unit. Such a back up system requires maintenance and run out of date soon due to a self discharge process.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112), such that applicant(s) reserve the right to disclaim, and hereby disclose a disclaimer of, any previously described product, method of making the product, or process of using the product.

SUMMARY OF THE INVENTION

It is an object to provide a water heater with an effective corrosion protection which also delivers an effective corrosion protection during power outages.

Accordingly, a water heater is provided which comprises a water storage tank made of enameled metal, an anode electrode (e.g. an anode rod) at least partly inside the water storage tank and a corrosion protection unit configured to impress current into the anode to provide a corrosion protection for the water storage tank. The corrosion protection unit further comprises a microprocessor configured to control the impressing of the current to the anode electrode during impression process cycles and to control the operation of the corrosion protection. The corrosion protection unit furthermore comprises a battery unit or an accumulator unit configured to supply energy to the microprocessor during grid power outages. The microprocessor is configured to activate the power saving mode during grid power outages during which an amount of impressed current and/or an impression process cycle is reduced.

According to an aspect of the invention, the water heater comprises a display and the microprocessor is configured to control an illumination of the display during the power saving mode.

According to a further aspect of the invention, the water heater comprises a button configured to activate an illumination of the display for a period of time during the power saving mode.

The invention also relates to a method of controlling a water heater having a water storage tank made of enameled metal, an anode at least partly inside the water storage tank and a battery unit or accumulator unit configured to supply energy during grid power outages. A current is impressed into the water using an anode electrode (e.g. an anode rod)

to provide a corrosion protection for the water storage tank. The impression of current to the water via the anode electrode and the operation of the corrosion protection are controlled. A power saving mode is activated during grid power outage. During the power saving mode the amount of impressed current and/or the number of impression process cycle are reduced.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
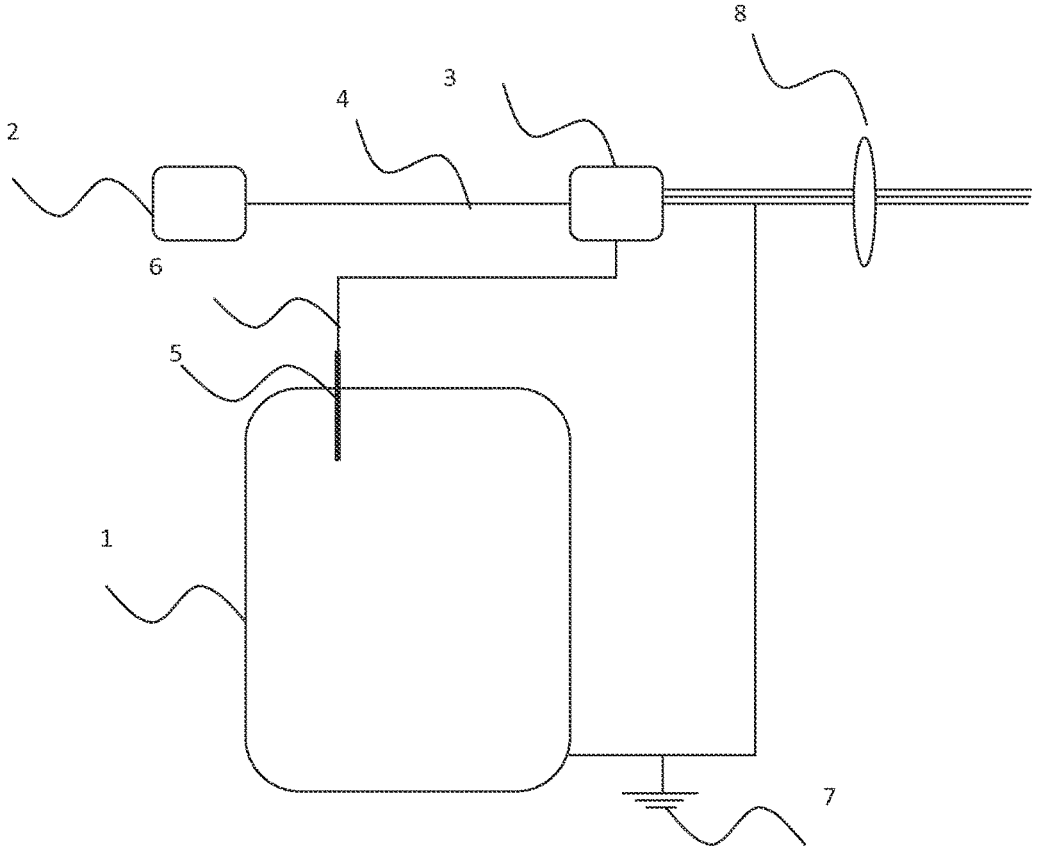
FIG. 1 shows a schematic representation of a water heater according to a first embodiment.

FIG. 1 shows a schematic representation of a water heater according to a first embodiment. The water heater comprises a metallic water tank 1, optionally a display 2, a corrosion protection unit 3, a metallic anode electrode like an anode rod 5, a grounded conductive point 7 and a grid connection 8. Between the display 2, which can be illuminated, and the corrosion protection unit 3, a connection 4 is provided. Between the anode rod 5 and the corrosion protection unit 3, a conductive connection 6 is provided.

The corrosion protection unit 3 handles the corrosion protection of the metallic water tank 1.

The display 2 may be an illuminated display, wherein the illumination of the display can be adjusted e.g. by dimming the illumination.

The display 2 may comprise or may be connected to an activation button.

Figure 2:
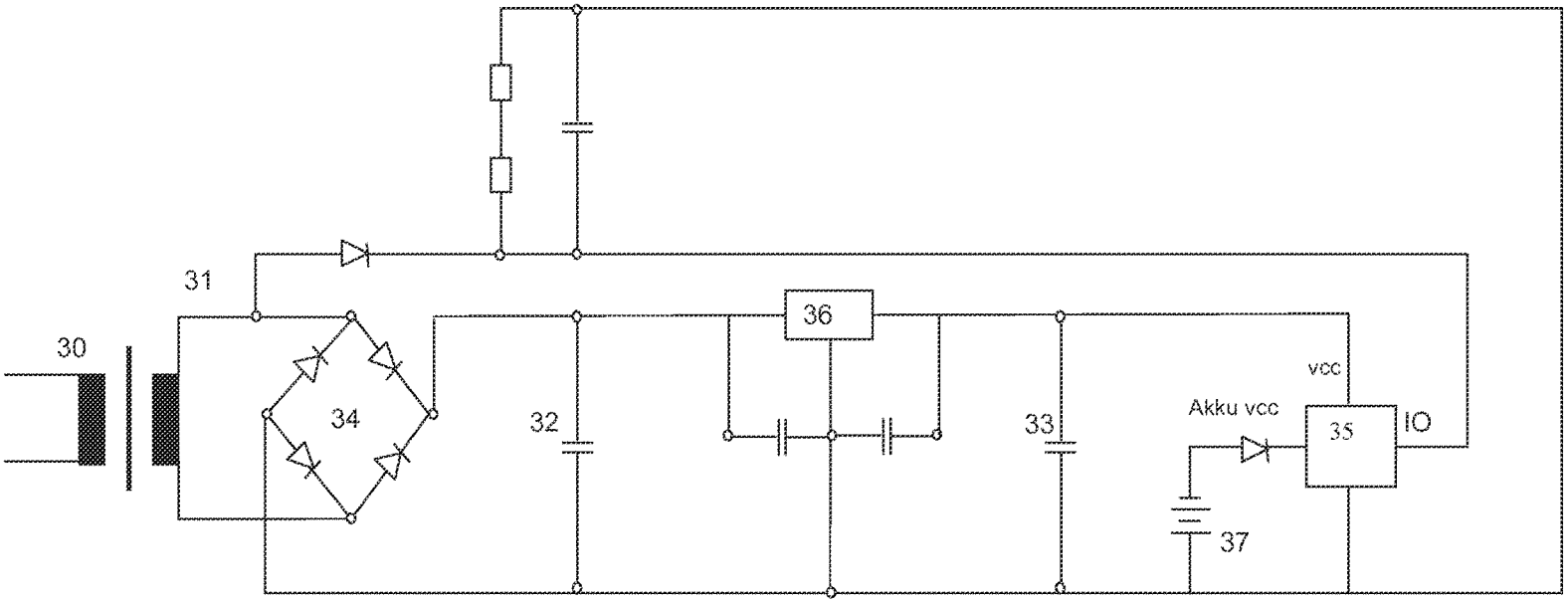
FIG. 2 shows a schematic circuit diagram of a corrosion protection circuit in the water heater according to FIG. 1.

FIG. 2 shows a schematic circuit diagram of a corrosion protection circuit in the water heater according to FIG. 1. The corrosion protection unit 3 comprises a net transformer 30, a measuring point 31, a first capacitor 32, a voltage stabilizing unit 36, a second capacitor 33, a microcontroller 35, and a battery or accumulator 37. The voltage stabilizing unit 36 serves to avoid a voltage drop in front of the microprocessor 35. Furthermore, it is used to stabilize the voltage supply via the port vcc of the microcontroller 35. In case of a power outage, a voltage drop is measured by the measuring unit 31 and a result thereof is forwarded to the input port IO of the microprocessor 35. The capacitor 32 in front of the voltage stabilizing unit 36 as well as the capacitor 33 supplies the microprocessor 35 via the port vcc with electrical power until an auxiliary power supply of the accumulator 37 is fully activated and is supplying electrical energy to the microprocessor 35 via the port Accu vcc.

In case of a power outage, the auxiliary power supply (namely the battery unit or accumulator unit 37) is activated and a current is impressed into the water inside the tank 1. However, during the power outage, the microprocessor 35 activates an energy reduction scheme, namely a power saving mode, to increase the lifetime of the battery or the accumulator 37. A reduction of the power consumption of the water heater can be performed by reducing the illumination of the display 2 and by regulating the operation of the corrosion protection unit 3. Therefore, in order to save energy, the display 2 may be deactivated or the illumination of the display 2 may be dimmed. Optionally, the illumination is activated if a push button is used. Apart from this, the illumination may be deactivated. By means of the operation of the corrosion protection unit 3, the energy consumption may also be reduced. This can, for example, be performed by reducing the current during impression process cycle, by reducing the number of current impression phase per hour and by reducing the current amount and the number of current impression phase per hour.

Accordingly, the display 2 can be controlled such that a dimmed illumination is activated only when a button is activated or pushed. The microprocessor 35 may be in a power saving mode.

It is important to maintain the corrosion protection of the tank 1 even in case of power outage. In these cases, the energy for the corrosion protection must be delivered by the battery unit or the accumulator unit 37. Because of an unknown duration of the power outage, it is important to control the operation of the corrosion protection unit 3 under consideration of an increased active lifetime of the battery or accumulator unit. Such a reduction of the power consumption can be performed by changing the passivation set point value from 2.1V to 1.9V or by reducing the passivation set point value by 10%. Alternatively or additionally, the cycle time between two current impressed events is increased in order to reduce the overall energy consumption. In addition or alternatively, a reduced number of current impression phase per hour and a reduced set point value may be acceptable during periods of power outage Furthermore, also a reduced current impressed duration may be provided during power failures. In addition or alternatively, a reduced number of current impression phase per hour, a reduced set point value and a reduced current impression duration can be acceptable during power failure. In addition or alternatively, the microcontroller 35 may activate a power saving mode between two current impression cycles.

In order to improve the safety of the corrosion protection scheme, a different system control states for the microcontroller and the corrosion protection unit are provided from the factory until the final place of operation of the water heater. This may include final test bench at the end of the production process, transportation to the customer, an operation at the place of installation connected to the grid, an operation under a grid power outage without draining the tank, an operation under a grid power outage with a draining of the tank and a sensor error.

In table 1 below the named different situations are described, where the backup function of the corrosion protection unit should be activated or not.

| Status unit | Grid connected | Dry fire prevention | Supply microprocessor | Reset button | Status display | Status anode |
|---|---|---|---|---|---|---|
| Final test bench | X | X | grid | X | ON | ON |
| transport | | | OFF | | OFF | OFF |
| operation | X | X | GRID | | ON | ON |
| Power outage full | X | X | Battery | | Power save | Power save |

-continued

| Status unit | Grid connected | Dry fire preven-tion | Supply micro-processor | Reset button | Status display | Status anode |
|---|---|---|---|---|---|---|
| tank | | | | | mode | mode |
| Power outage | X | | Battery | | OFF | OFF |
| tank drained | | | | | | |
| Sensor failure | X | X | Grid/ battery | | ON | ON |

In the following, several of these examples are described. If, for example, the battery unit 37 has been assembled, on the final test bench but the water heater has not yet been finally installed, the operation of the current impressed anode as well as, for example, a dry fire protection is active as long as the unit is not connected to the grid. Optionally, a reset button can be provided, for example, on or in the corrosion protection unit 3 in order to deactivate the microprocessor power supply, the display power supply, a supply of the anode, for example, during the storing in a warehouse and the transportation of the water heater.

Instead of pushing a reset button, this operation may also be performed by a software reset e.g. after the testing on the final test bench has been successfully concluded. In other words, a transport lock setting can be thus provided. Furthermore, if the unit is connected to grid at the final installation place, the transport lock setting can be deactivated e.g. by means of the grid voltage.

In addition, if the water from the tank is supposed to be drained during a period of power outage or during a longer absence, the power supply for the display, the anode and the microprocessor may be deactivated automatically. This may be activated automatically if the dry fire protection is activated after a draining of the water inside the tank. If the power outage is over, the microcontroller 35 can be reactivated simply by the power supply via the port vcc. Then, the power supply via the battery unit 37 can be deactivated and the power saving mode can be deactivated as well.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A water heater, comprising:

a water storage tank made of enameled metal;

an anode electrode arranged at least partly inside the water storage tank; and a corrosion protection unit configured to impress current into the anode electrode during impression process cycles to provide a corrosion protection for the water storage tank;

wherein said corrosion protection unit comprises:

a microprocessor configured to control the impressing of current to the anode electrode and to control operation of the corrosion protection; and a battery unit or accumulator unit configured to supply energy to the microprocessor during grid power outages;

wherein said microprocessor is configured to activate a power saving mode during grid power outage; and wherein, in the power saving mode, an amount of impressed current and/or a number of impression process cycles is reduced in order to change a passivation set point value.

2. The water heater according to claim 1, further comprising:

a display;

wherein said microprocessor is configured to control an illumination of the display during the power saving mode.

3. The water heater according to claim 2, further comprising:

a button configured to activate an illumination of the display for a period of time during the power saving mode.

4. A method of controlling a water heater having a water storage tank made of enameled metal, an anode electrode at least partly inside the water storage tank, and a battery unit or accumulator unit configured to supply energy during grid power outages, comprising the steps of:

impressing current during impression process cycles using an anode electrode to provide a corrosion protection for the water storage tank;

controlling the impressing of current to the anode electrode and controlling operation of the corrosion protection; and activating a power saving mode during grid power outage;

wherein, in the power saving mode, an amount of impressed current and/or a number of impression process cycles is reduced in order to change a passivation set point value.

* * * * *